US005733145A

United States Patent [19]

Wood

[11] Patent Number: 5,733,145

[45] Date of Patent: Mar. 31, 1998

[54] SEAL ASSEMBLY FOR OVERMOLDED METAL STRUCTURE

[75] Inventor: Richard G. Wood, Magnolia, Tex.

[73] Assignee: Tescorp Seismic Products, Inc., Stafford, Tex.

[21] Appl. No.: 816,859

[22] Filed: Mar. 13, 1997

[51] Int. Cl.[6] ..... H01R 13/58

[52] U.S. Cl. ..... 439/604; 439/589

[58] Field of Search ..... 439/604, 606, 439/589, 587

[56] References Cited

U.S. PATENT DOCUMENTS 3,816,641 6/1974 Iversen ..... 439/604 X
4,053,201 10/1977 Grappe ..... 439/604 X
4,790,768 12/1988 Domingues ..... 439/320
5,616,049 4/1997 Schwager et al. ..... 439/589 X

*Primary Examiner*—Neil Abrams
*Assistant Examiner*—Daniel Wittels
*Attorney, Agent, or Firm*—Jenkens & Gilchrist, P.C.; P. Weston Musselman, Jr.; Robert A. McFall

[57] ABSTRACT

A rigid nonmetallic shell provides a reaction surface for seal members disposed in a groove in a metal housing. The rigid shell, and at least a portion of the metal housing, are overmolded with a plastic or elastomeric material that is self-bonding with the rigid shell to provide a molecular bond between the overmolded cover and the rigid shell. The present invention effectively addresses the problem of providing a leakproof seal between a metal housing and an overmolded plastic or elastomeric structure surrounding the metal housing.

12 Claims, 1 Drawing Sheet

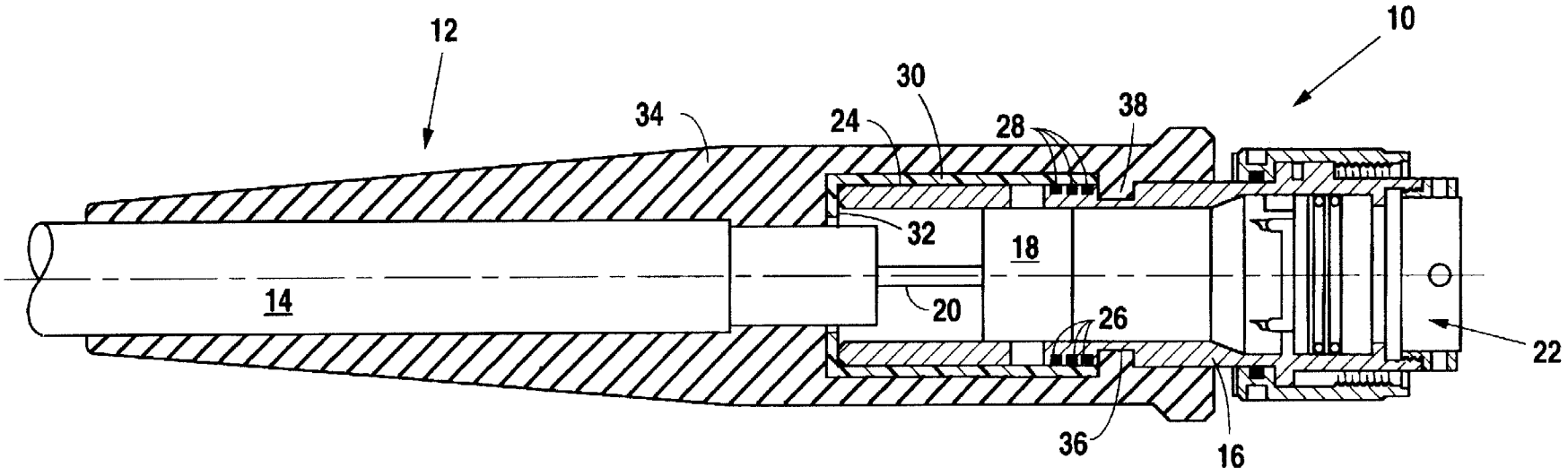
10
12
14
16
18
20
22
24
26
28
30
32
34
36
38

SEAL ASSEMBLY FOR OVERMOLDED METAL STRUCTURE

BACKGROUND OF THE INVENTION

1. Technical Field

This invention relates generally to a static seal structure, and more particularly to such a structure suitable for use in underwater applications.

2. Background Art

O-ring and similar type static seals, are commonly used to provide fluid-tight connections for electrical connectors, pipes, hoses, and the like. These structures often have a metal housing connected to the cable, pipe, or hose, and an outer metal shell circumferentially disposed about the housing which has an inner diameter sized to provide a slight interference fit with the seal when the seal is positioned between the housing and the outer shell. O-rings are the most common form of static seals in such structures, although other seal arrangements such as square rings, D-rings, T-rings and lobed rings are also frequently used in static seal applications. O-rings are inexpensive, seal in both directions, and require only about a 10% squeeze, or interference fit, to seal pressures up to 1,500 psi, or even higher when formed of special elastomer compositions.

It is often desirable to provide a plastic overmolding over the outer metal shell, and at least a portion of the housing of the sealed structures. For example, plastic and elastomer overmoldings are commonly used on pipes and hoses to provide easier handling when joining mating components, increased impact shock protection, and inhibit corrosion of the metal components. Also, plastic and elastomer overmoldings are commonly used on electrical connectors to provide a bonded seal with the jacket, or sheath, of a cable assembly as well as protection for the metallic components of an electrical cable assembly, such as underwater cable assemblies.

However, overmolding of metallic structures with a plastic or elastomeric material has only been partially successful. It is extremely difficult to provide a strong mechanical bond between nonmetallic and metallic materials. Typically, adhesives or other bonding agents are required to mechanically secure a plastic or elastomeric covering over metal surfaces. Mechanical adhesive bonding is prone to separation during use. In particular, it has been found that in underwater applications, such as in deep sea environments, elastomer overmolding over metallic housing components is prone to delamination and subsequent separation from the metallic substrate whereby water is able to leak through the interface, wick around a sealed end of the metallic housing, and cause a short to occur between electrical contacts arranged within the metal housing.

One attempt to provide an immersible electrical coupling having an overmolded cover surrounding a metallic housing is disclosed in U.S. Pat. No. 4,790,768, issued Dec. 3, 1988 to Henri Domingues. The Domingues connector is formed of a complex arrangement of a large number of metallic components, including a necessary metallic armature component of the cable itself, to prevent leakage through the multi-component metal housing structure into the interior of the connector. Domingues also has a plurality of O-rings internally disposed inside the metallic housing to prevent leakage into the interior of the connector. The connector assembly proposed by Domingues is not only complex, but would be difficult to assemble, costly to produce, and prone to failure at the interconnection joints between the several metallic components.

The present invention is directed to overcoming the problems set forth above. It is desirable to have a seal assembly for a metallic housing that can be overmolded with a protective plastic or elastomeric covering that is molecularly bonded to a compositionally compatible rigid plastic member providing a reaction surface for a seal member externally disposed about the metallic housing. It is also desirable to have such an assembly that is easy to produce and assemble and does not require a large number of added components in the structure. Also, it is desirable to have such a seal assembly wherein the overmolded cover extending around at least a portion of the metallic housing, is also molecularly bonded to the external jacket of an electrical cable assembly or to the outer surface of a hose or a pipe.

SUMMARY OF THE INVENTION

In accordance with one aspect of the present invention, a static seal assembly has a metal housing in which at least one groove is provided in an external cylindrical surface of the housing. The static seal assembly also includes a seal member disposed in each one of the grooves provided in the cylindrical outer surface, and a rigid shell encompassing a defined portion of the metal housing and compressing the seal member between the shell and the housing by an amount sufficient to prevent fluid leakage around the seal member. The static seal assembly further comprises an overmolded cover that is disposed in surrounding relationship around the rigid shell and encompasses at least a portion of the metal housing. The overmolded cover is molecularly bonded to the rigid shell and is in intimate contact with the aforementioned portion of the metal housing.

Other features of the static seal assembly embodying the present invention include the housing having three axially aligned grooves with a seal member disposed in each of the grooves. Other features include the seal members being O-rings and the rigid shell being formed of a glass-filled polyurethane, polyethylene or nylon, and the overmolded cover being respectively formed of polyurethane, polyethylene or nylon.

In accordance with another aspect of the present invention, a seal assembly for an underwater electrical connector attached to an electrical cable includes a metal housing having a cylindrical outer surface, a first end adapted to receive the electrical cable therethrough, a second end adapted to receive an electrical contact assembly therein and join with a mating connector, and at least one groove formed in the cylindrical outer surface. The seal assembly for an underwater electrical connector further includes a seal member disposed in the groove, or grooves, defined in the cylindrical outer surface of the metal housing. A rigid shell is disposed in encompassing relationship over a predefined portion of the metal housing and compresses the static seal member by an amount sufficient to prevent fluid leakage. The seal assembly for an underwater electrical connector also includes an overmolded cover that surrounds the rigid shell and encompasses at least a portion of the metal housing and the electrical cable. The overmolded cover is molecularly bonded to the rigid shell and to a portion of the plastic covering of the electrical cable, and is in intimate contact with a portion of the metal housing.

BRIEF DESCRIPTION OF THE DRAWINGS

A more complete understanding of the structure and operation of the present invention may be had by reference to the following detailed description when taken in conjunction with the single drawing FIGURE, which is a side view of an underwater electrical connector, showing the components of the seal assembly embodying the present invention in section and the cable and other components of the connector in elevation.

DETAILED DESCRIPTION OF THE INVENTION

The static seal assembly embodying the present invention is applicable to devices such as pipes, hoses, and electrical cables that have a metal housing at the termination end of the article. In the following illustrative preferred embodiment of the present invention, a static seal assembly 10 is shown in association with an underwater cable 12 having a polyurethane outer jacket or covering 14. A metal housing 16 is attached to the termination end of the underwater cable 12 and includes a yoke 18 mounted in the housing 16 and attached to a centrally disposed stress transfer member 20. A conventional electrical contact assembly 22, such as the contact assembly described in U.S. Pat. No. 5,387,119, issued Feb. 7, 1995 to the inventor of the present invention, is disposed in the end of the housing 16 and is adapted to receive a mating connector, not shown. The outer diameter, or circumference, of the metal housing 16 is defined by a cylindrical surface 24 formed on a rear portion of the housing 16 and has at least one annular groove 26 defined in a forward portion of the cylindrical surface 24. In the preferred embodiment, each of the grooves 26 are constructed to receive an annular O-ring 28 in each of the grooves. Alternatively, the grooves 26 may be formed to receive a rectangular cross-section ring, quad-section ring, H-section ring, T-ring, heart-section ring normally used with a backup ring, or other conventional static annular seal ring.

Importantly, the static seal assembly 10 embodying the present invention includes a rigid shell 30 that surrounds the cylindrical surface 24 of the housing 16 and compresses the seal member, or members, 28 between the rigid shell 30 and the bottom of the respective groove 26 in the housing 16. Typically, O-rings will seal pressures up to 1,500 psi with a 10% squeeze factor, i.e., the undeformed cross-sectional diameter of the O-ring is reduced 10% by the abutting surfaces. Advantageously, when the static seal assembly 10 embodying the present invention is subjected to very high external pressures such as in undersea applications, the external pressure acts isostatically on the external surfaces of the assembly, and thereby increases compression of the O-ring. Thus, in the present embodiment, it is sufficient to provide only normal compression, i.e., a 10% squeeze factor, of the O-ring seal to prevent fluid leakage around the seal member 28 even when the connector is deeply submerged.

Also, importantly, the rigid shell 30 embodying the present invention is formed of a plastic material, such as glass-filled polyurethane or polyethylene desirably having a Shore D hardness of at least 85. The wall thickness of the rigid shell 30 should be sufficient to prevent localized deflection or bending in the area of contact with the seat members 28. The required thickness of the wall of the rigid shell 30 is primarily dependent on the flexural modulus of the material from which the rigid shell 30 is formed. In the illustrative embodiment, the rigid shell 30 is formed of a glass-reinforced polyurethane material having a flexural modulus of about 650,000 psi, a surface hardness of about 80 D, and a thickness of from about 0.15 inches to about 0.20 inches. Also, the material from which the rigid shell 30 is formed should be self-bonding with any material to be overmolded around the shell 30.

In addition to covering the cylindrical surface 24 of the housing 16, the rigid shell 30 in the illustrative embodiment of the present invention, also has a radially inwardly extending shoulder 32 at a rearward end of the shell which extends over the rear end of the housing 16 and provides a circular opening for the end of an electrical cable from which a portion of the jacket 14 has been removed. The shoulder 32 aids in positioning the rigid shell 30 over the housing 16, and in maintaining the respective assembled positions during subsequent handling and placement of the assembled housing 16, seal members 28, rigid shell 30, and the cable 12, into a mold cavity.

The static seal assembly 10 comprising the present invention, also includes an overmolded outer cover 34 that completely encloses the rigid shell 30 in a circumambient manner. The overmolded cover 34 is preferably formed by placing the assembled metal housing 16, rigid shell 30, and the sealed members 28 installed between the housing 16 and shell 30, in a mold cavity in spaced relationship with respect to the walls of the mold, and the material comprising the overmold cover 34 poured into the mold, preferably by injection molding. The overmolded cover 34 may be molded as a single component, or formed in two or more separate molding steps. In the present invention, it is highly desirable that the material forming the overmold cover 34 be capable of being melt bonded, i.e., molecularly fused, with the rigid shell 30, and in the illustrative embodiment with the cable jacket 14, and thereby form a molecularly fuzed joint between the overmold jacket 34, the rigid shell 30 and the cable jacket 14.

As illustrated in the drawing, the metal housing 16 also has an annular groove 36 formed ahead of the annular seal grooves 26. The relatively wide annular groove 36 provides a recess for formation, during molding, of an inwardly extending shoulder 38 on the cover 34. Thus, the shoulder 38 is an integral part of the overmolded cover 34 and provides mechanical retention of the overmolded cover 34 on the housing 16. The portion of the overmolded cover 34 overlying the housing 16 is only mechanically secured to the housing 16 and, therefore, there is no chemical bond or seal between the cover 34 and the portion of the housing 16 forward of the cylindrical surface 24. Thus, while water can leak into the interface between the overmolded cover 34 and the housing 16 ahead of the cylindrical surface 24, the seal members 28 effectively prevent leakage into the interior of the housing 16. Also, the molecular bond between the overmolded cover 34 and the rigid shell 30 prevents leakage around the outer surface of the rigid shell 30. In similar manner, the molecular bond between the overmolded cover 34 and the cable jacket 14 prevents leakage between the interface of those two members.

While the overmolded cover 34 may desirably be formed of any plastic or elastomeric material that is molecularly bondable with the underlying rigid shell 30, in the present embodiment the overmolded cover 34 is formed of a polyurethane elastomer having a hardness less than that of the rigid shell 30. However, if desired, the overmolded cover 34 may be formed of a rigid material having a composition similar to, or at least self-bonding with, the rigid shell 30.

Thus, the static seal assembly 10 embodying the present invention provides a means of providing a watertight seal around a member disposed externally of a mechanical seal member. The present invention avoids the problem of adhesively bonding an outer jacket, or cover, over metal seal components. Also, the present invention provides an economical assembly for sealing metallic housings and providing an overmolded cover around the housing. Although the preferred exemplary embodiment of the present invention is described in association with an underwater electrical connector, it can be readily seen that the seal assembly 10 embodying the present invention is also applicable to pipes and hoses formed of either plastic or elastomeric materials and which have a metal connector attached to an end of the pipe or hose.

Although the present invention is described in terms of a preferred exemplary embodiment, with specific key constructions and materials, those skilled in the art will recognize that changes in those constructions and materials may be made without departing from the spirit of the invention. Such changes are intended to fall within the scope of the following claims. Other aspects, features, and advantages of the present invention may be obtained from a study of this disclosure and the drawings, along with the appended claims.

What is claimed is:

1. A static seal assembly, comprising:

a metal housing having an outer diameter defined by a cylindrical surface and at least one groove defined in said cylindrical surface;

a seal member disposed in each of said at least one groove defined in the cylindrical outer surface of the metal housing;

a rigid shell disposed in encompassing relationship over a predefined portion of said metal housing and compressing said seal member between said shell and said housing by an mount sufficient to prevent fluid leakage around said seal member at a predetermined pressure differential across said seal member; and an overmolded cover circumambiently disposed around said rigid shell and encompassing at least a portion of said metal housing, said cover being molecularly bonded with said rigid shell and in intimate contact with said portion of the metal housing.

2. A static seal assembly, as set forth in claim 1, wherein said housing has three axially spaced grooves each having one of said seal members disposed therein.

3. A static seal assembly, as set forth in claim 2, wherein said seal members are O-ring seals.

4. A static seal assembly, as set forth in claim 1, wherein said rigid shell is formed of glass-filled polyurethane and said overmolded cover is formed of polyurethane.

5. A static seal assembly, as set forth in claim 1, wherein said rigid shell and said overmolded cover are formed of polyethylene.

6. A static seal assembly, as set forth in claim 1, wherein said rigid shell and said overmolded cover are formed of nylon.

7. A seal assembly for an underwater electrical connector attached to an electrical cable enclosed within a waterproof jacket, comprising:

a metal housing an outer diameter defined by a cylindrical surface concentrically disposed about a longitudinal axis, a first end adapted to receive said electrical cable therethrough, a second end spaced from said first end and adapted to receive an electrical contact assembly therein and join with a mating connector, and at least one groove defined in said cylindrical surface in perpendicular relationship with said longitudinal axis;

a seal member disposed in each of said at least one groove defined in the cylindrical outer surface of the metal housing;

a rigid shell disposed in encompassing relationship over a predefined portion of said metal housing and compressing said static seal member between said shell and said housing by an amount sufficient to prevent fluid leakage around said seal member at a predetermined pressure differential across said seal member; and an overmolded cover circumambiently disposed around said rigid shell and encompassing at least a portion of said metal housing and said electrical cable, said cover being molecularly bonded to said rigid shell and to a portion of the jacket enclosing said electrical cable, and is in intimate contact with said portion of the metal housing.

8. A seal assembly, as set forth in claim 7, wherein said housing has three axially spaced grooves each having one of said seal members disposed therein.

9. A seal assembly, as set forth in claim 8, wherein said static seal members are O-ring seals.

10. A seal assembly, as set forth in claim 7, wherein said rigid shell is formed of glass-filled polyurethane, and said electrical cable jacket and said overmolded cover are formed of polyurethane.

11. A seal assembly, as set forth in claim 7, wherein said rigid shell, said overmolded cover, and said cable jacket are formed of polyethylene.

12. A seal assembly, as set forth in claim 7, wherein said rigid shell, said electrical cable jacket, and said overmolded cover are formed of nylon.

* * * * *